United States Patent [19]

Klundt

[11] Patent Number: 4,943,255

[45] Date of Patent: Jul. 24, 1990

[54] BUBBLE MAKING TOY WITH TWO WANDS AND A WICK COMPRISING THREE SEGMENTS

[75] Inventor: Kalvin K. Klundt, Lagrange, Ky.

[73] Assignee: The Big Time Toy Co., Louisville, Ky.

[21] Appl. No.: 127,653

[22] Filed: Dec. 2, 1987

[51] Int. Cl.[5] ..... A63H 33/28

[52] U.S. Cl. ..... 446/15; 446/21; 446/489

[58] Field of Search ..... 446/15, 16, 17, 18, 446/19, 20, 21, 487, 489, 490

[56] References Cited

U.S. PATENT DOCUMENTS

| | | | |
|---|---|---|---|
| 2,606,395 | 8/1952 | Fulton | 446/15 |
| 2,928,205 | 3/1960 | Fulton | 446/15 |
| 3,064,387 | 11/1962 | Campbell | 446/21 |
| 4,152,864 | 5/1979 | Habisohn | 446/15 |
| 4,654,017 | 3/1987 | Stein | 446/15 |

FOREIGN PATENT DOCUMENTS

WO86/05408 9/1986 PCT Int'l Appl. .

OTHER PUBLICATIONS

*Good Clean Fun Bubble Hoop The Exploratorium* from San Francisco Museum of Science Art and Human Perception, copyright 1987.

*Primary Examiner*—Robert A. Hafer
*Assistant Examiner*—Sam Rimell
*Attorney, Agent, or Firm*—Amster, Rothstein & Ebenstein

[57] ABSTRACT

Apparatus for forming and controlling bubbles formed from a bubble solution includes a continuous three segment flexible wick for storing and releasing quantities of a bubble solution, one segment of which is equal in length to the combined length of the other segments. A control wand is fixedly secured to the wick between adjacent portions of the second and third segments, and a support wand is fixedly secured to the wick between adjacent portions of the first and second segments to control the formation and size of a bubble formed from the bubble solution. A weight is fixed to the wick at a point between the first and third segments. The wands are capable of moving the wick between a bubble-initiating position and a bubble-developing position.

32 Claims, 2 Drawing Sheets

FIG. 2
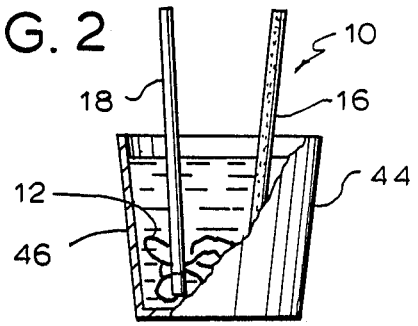
FIG. 3
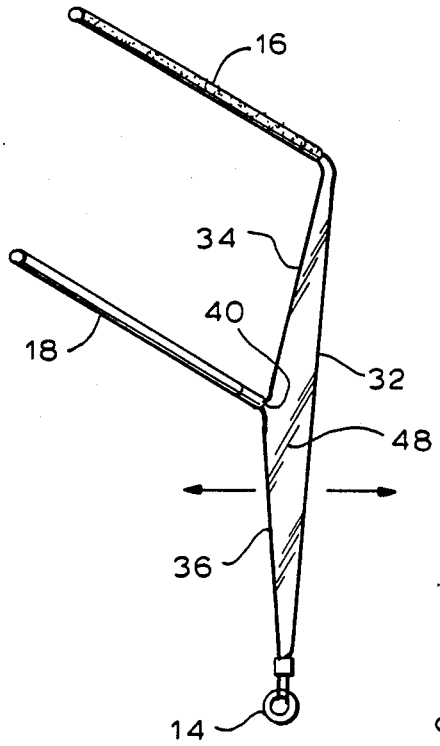
FIG. 4
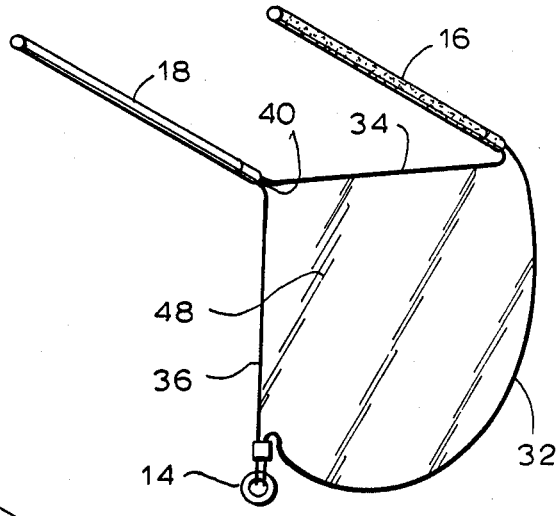
FIG. 5
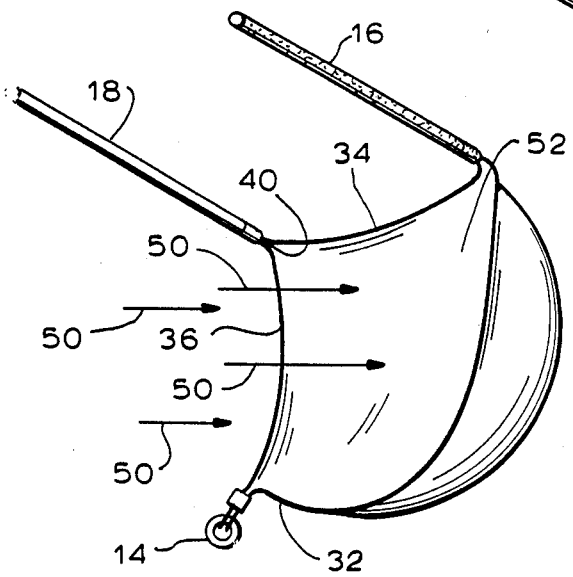
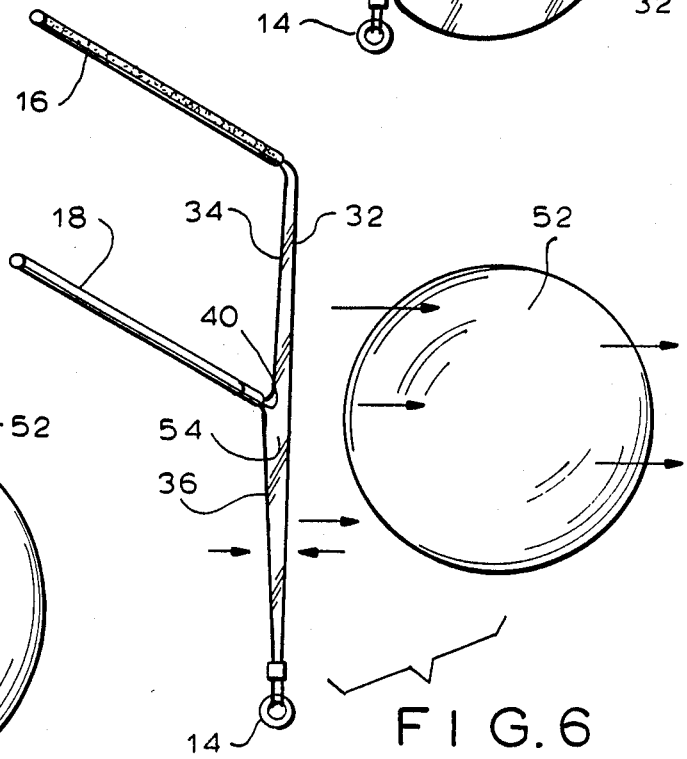
FIG. 6

BUBBLE MAKING TOY WITH TWO WANDS AND A WICK COMPRISING THREE SEGMENTS

BACKGROUND OF THE INVENTION

The present invention relates to bubble toys, and more particularly to bubble toys that are capable of producing large bubbles.

In creating a stable cylindrical bubble, the length of the bubble must not exceed three diameters, or constrictions will develop that ultimately divide or burst the bubble. In order to maximize the size of a bubble, an apparatus must meet three criteria. The first is that the apparatus must allow for precise control of the proportions of the bubble during its creation. The second is that a maximum area for a bubble-forming "loop" is required. And lastly, the apparatus must include means for supplying a substantial quantity of solution to the loop while allowing for its quick release during bubble formation.

Heretofore, large bubbles have been formed by a variety of methods involving the immersion of bubble producing apparatus in bubble solutions to form films. Once a film is formed, a volume of air is passed through the apparatus to expand the film until a bubble is formed.

One type of bubble producing apparatus used to form large bubbles consists of a large rigid hoop constructed of wire. To make a large bubble, the hoop must first be completely submerged in a vat of bubble solution so that a soap film becomes attached to the hoop. In order to form a bubble, the hoop must be swung in an arc to force air against the film, thereby stretching it into a bubble tube. In order to detach the bubble from the hoop, the tube must be sealed by a series of intricate maneuvers with the hoop which do not allow for adequate control of the bubble. In employing this type of apparatus, the size of the bubble is directly proportionate to the size of the hoop. Thus, if the formation of a large bubble is desired, a large hoop and a large vat adequate to accommodate the hoop are required If too big a hoop is used, it becomes unwieldy. A further disadvantage is that successive bubbles cannot be formed from the hoop. The hoop must be immersed in the vat of bubble solution each time a bubble is to be formed.

U.S. Pat. No. 4,654,017 discloses a single rod construction which provides only a small degree of control over the formation and size of bubbles. Its sliding mechanism, which is integrated with the rod and aids in the support of a bubble-forming loop, does not allow for proper formation and separation of the bubble from the loop because the loop segments are not substantially flush due to the presence of gaps. The apparatus does not reliably provide for a succession of bubbles without having to re-immerse the loop in a vat of bubble solution each time a bubble is to be formed.

Accordingly, it is an object of the present invention to provide a bubble-making apparatus which provides a fine degree of control over the formation and size of bubbles.

Another object is to provide such an apparatus which allows for the formation of giant size bubbles.

A further object is to provide such an apparatus having a non rigid bubble-forming loop which can be immersed in a small vat or container of bubble solution.

It is also an object to provide such an apparatus which is capable of successively yielding bubbles.

It is another object is to provide such an apparatus which allows for effective separation of the bubble from the bubble-forming loop.

It is a further object to provide such an apparatus which is lightweight, easy to use and easy to maintain.

Still another object is to provide an apparatus which is of simple and economical construction, inexpensive to manufacture and use, and enjoyable in use by both children and adults alike.

SUMMARY OF THE INVENTION

It has now been found that the above and related objects of the present invention are attained in an apparatus for forming and controlling bubbles formed from a bubble solution comprising substantially operatively continuous wick means, a weight means, a control wand and a support wand. The wick means is used for storing and releasing quantities of a bubble solution and includes, in series, a first elongate segment, a second elongate segment and a third elongate segment. The first and third segments define a point therebetween, and the first segment is substantially equal in length to the second and third segments combined. The control wand and the support wand control the formation and size of a bubble formed from the bubble solution. Each wand has a wick receiving portion for receiving and securing the wick means to the wand. The wick receiving portion of the support wand receives and secures adjacent portions of the first and second segments, and the wick receiving portion of the control wand receives and secures portions of the second and third segments. A weight means is secured to the point between the first and third segments of the wick means. In a preferred embodiment, contact means composed of wick filler substantially occupies a gap formed between the portions of the second and third segments received and secured by the wick receiving portion of the control wand.

Preferably the wands are capable of moving the wick means between a bubble initiating position and a bubble-developing position. In the bubble-initiating position, the control wand causes the contact means to be in substantial contact with the first segment, the weight means causes the third segment and a lower portion of the first segment to be substantially flush against each other, and the support wand causes the second segment and an upper portion of the first segment to be substantially flush against each other so that a film is formed between the contact means and the segments. In the bubble-developing position the contact means and portions of the second and third segments are substantially spaced apart from the first segment so that a bubble may be formed from the film.

Thus, the weight means and the support wand define therebetween the first segment of the wick means, the support wand and the control wand define therebetween the second segment of the wick means, and the weight means and the control wand define therebetween the third segment of the wick means.

In a preferred embodiment, the first and second segments depend from the support wand and the third segment depends from the control wand in the bubble-initiating position, and the second segment depends from both the control wand and the support wand in the bubble developing position. The weight means and the support wand are closer together in the bubble developing position than in the bubble-initiating position, and the second and third segments and the contact means are substantially (preferably totally) flush all along the length of the first segment in the bubble initiating position.

The control wand and the support wand are adapted to move the wick means from the bubble developing position to a bubble releasing position, wherein the second and third segments and said contact means are substantially flush against the first segment, so that the formed bubble is sealed and released.

Preferably the apparatus is capable of successively forming bubbles from the bubble solution stored in said wick means. Therefore, the bubble releasing position for one bubble is the bubble initiating position for a successive bubble, the weight means being positioned opposite the wick-receiving portion of the support wand in both the bubble initiating and bubble releasing positions.

In a preferred embodiment, the control wand and support wand each have a different visual appearance and a handle portion adjacent one end thereof for manually grasping the wand.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 2 is a partially broken away side elevation view of the bubble toy immersed in a vat or container of bubble solution;

FIG. 3 is an isometric view of the bubble toy, in operation, in a position intermediate the bubble initiating and bubble developing positions and having a film attached to the bubble-forming loop;

FIG. 4 is an isometric view of the bubble toy of FIG. 3 in the bubble-developing position.

FIG. 5 is an isometric view of the bubble toy of FIG. 4 showing a volume of air expanding the film; and FIG. 6 is an isometric view of a bubble and the bubble toy of FIG. 5 after the film has been sealed and detached from the loop to form the bubble.

DETAILED DESCRIPTION OF THE PREFERRED EMBODIMENTS

Figure 1:
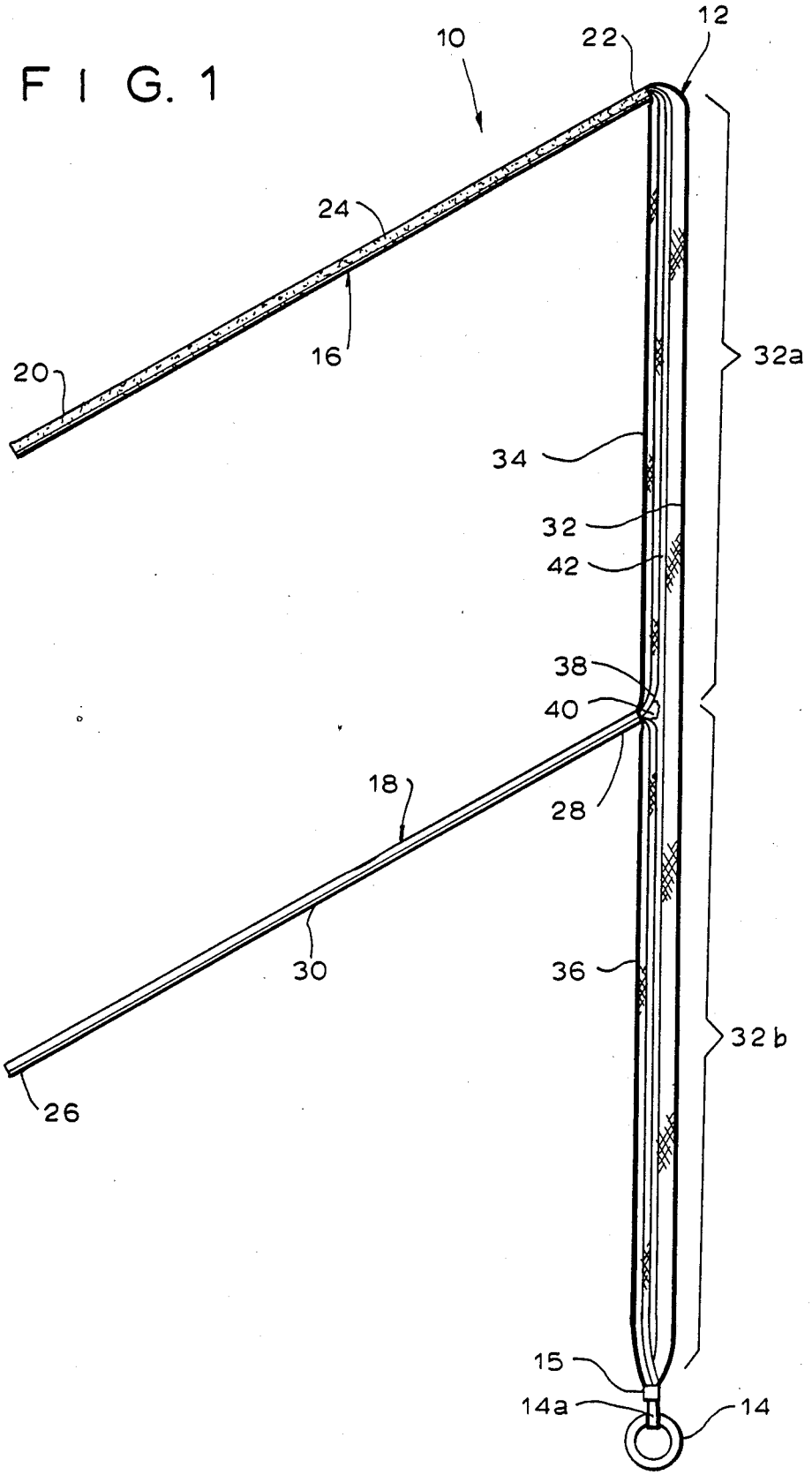
FIG. 1 is a side elevation view of the bubble toy according to the present invention.

Referring now to the drawing, and in particular to FIG. 1 thereof, therein illustrated is a bubble toy incorporating one embodiment of the present invention, generally designated by the reference numeral 10. The bubble toy 10 comprises an operatively continuous wick means generally designated 12, a weight means 14 attached to the wick means 12 at a point 14*a*, and a pair of wands attached to the wick means 12—namely, a support wand generally designated 16 and a control wand generally designated 18.

The support wand 16 includes a handle portion 20, a wick-receiving portion 22 and an elongated shank portion 24 located between the handle portion 20 and the wick receiving portion 22. Similarly, the control wand 18 includes a handle portion 26, a wick receiving portion 28 and an elongated shank portion 30 located between the handle portion 26 and the wick receiving portion 28. The handle portions 20 and 26 are shaped so that they each can be easily gripped by a human hand. The support wand 16 and the control wand 18 are constructed of a rigid material such as plastic or wood. The wands 16 and 18 are annular in cross-section although rectangular, polygonal or other cross-sections may be used as well. To differentiate the wands from each other, the support wand 16 and the control wand 18 have different visual appearances, as shown by the stippling of the support wand 16 in the figures. This can be accomplished, for example, by coloring the control wand 18 blue and the support wand 16 red or by providing them with different cross sections.

The wick means 12 includes, in series, a first segment 32, having an upper portion 32*a* and a lower portion 32*b*, located between the support wand 16 and the weight means 14, a second segment 34 located between the support wand 16 and the control wand 18, and a third segment 36 located between the control wand 18 and the weight means 14. The weight means 14 is fixed to the point 14*a* which is located between the first segment 32 and the third segment 36. Preferably, the length of the first segment 32 is substantially equal to the combined lengths of the second segment 34 and the third segment 36, and the second segment 34 and the third segment 36 are essentially of equal length. One suitable length for the first segment is three feet although larger and shorter lengths may be used.

The wick means 12 preferably consists of a single length of cord, as shown, with the first segment 32, the second segment 34 and the third segment 36 being divisions of the single length. In this way, the wick means 12 can be secured to the wick receiving portion 22 of the support wand 16 by recessing adjacent portions of the first segment 32 and the second segment 34 into a cavity, not shown, bored into the wick receiving portion 22 of the support wand 16, by any of the known boring methods. And the wick means 12 can be secured to the wick receiving portion 28 of the control wand 18 by recessing the two free ends of the wick means, that is, portions of the second segment 34 and the third segment 36, into a cavity, not shown, bored into the wick receiving portion 28 of the control wand 18 also by any of the known methods.

The wick means 12 is constructed of a material that is capable of storing and releasing large quantities of bubble solution, while at the same time being able to allow for its quick release during bubble formation. In this way, successive bubbles can be formed without having to re immerse the wick means in the bubble solution each time a bubble is to be formed. It is recommended that the wick means be constructed of double-rolled, 100% cotton jersey, T-shirt material having a locked weave.

When the wick-receiving portion 28 of the control wand 18 receives and secures portions of the second segment 34 and the third segment 36, an effective gap 38 in the linear continuity of the second segment 34 and the third segment 36 is invariably formed therebetween, especially when the segments are in the bubble initiating position with the second and third segments substantially aligned in end to end disposition. In order to fill the gap 38, a contact means 40 substantially occupies and projects slightly outwardly from the gap 38 towards the first segment 32. The contact means 40 is composed of wick filler which may be of the same material as the wick means 12. It is recommended that since the two free ends of the wick means 12 converge into the wick receiving portion 28 of the control wand 18, the contact means 40 should consist of an extension of either the second segment 34 or the third segment 36. This is accomplished by folding over a portion of the end of either segment and recessing it into the cavity so that the contact means 40 substantially occupies and projects slightly outwardly from the gap 38.

It will be readily appreciated by those skilled in the art that it is within the scope of the present invention for the first segment 32, the second segment 34, and the third segment 36 to consist of individual lengths of material or any other number of lengths so long as the segments, in toto, in conjunction with the wick receiving portions 22 and 28 and the contact means 40, form an operatively continuous loop. The various segments can be secured to wick-receiving portions 22 and 28 by any of the known methods.

The weight means 14 is in the shape of a ring. A sleeve 15 fits over lower ends of the third segment 36 and the first segment lower portion 32*b* and functions to fix the weight means 14 in position on the wick means 12, and to decrease the space between the lower ends of the first and third segments because the wick means 12 is threaded through the sleeve 15. By moving the sleeve 15 away from the weight means 14, the weight means can be slidably adjusted along the length of the wick means 12 in order to balance the apparatus 10 by ensuring that the combined length of the second and third segments 34 and 36 equals the length of the first segment 32.

Referring now to FIG. 2 in particular, in operation an operator of the apparatus 10 grips the handle portions 20 and 26 of the control wand 18 and the support wand 16, respectively, and dips a portion of the apparatus 10 in a vat 44 containing bubble solution 46. Since the wick means 12 is non-rigid and easily collapsible, the vat 44 need only be of a modest size to accommodate the weight 14, at least a portion of the wick means 12 and the wick-receiving portions 22 and 28. It is recommended that the handle portions 20 and 26 of the wands be kept out of the bubble solution 46 if the user's hands are to be kept dry. The wick means 12 should be immersed in the bubble solution 46 until it becomes saturated. When the wick means 12 is dry, the immersion time amounts to approximately one minute; when it is already moist, substantially less.

A preferred bubble solution 46 consists of a mixture of 1 cup of dishwashing detergent, 8 cups of water and 3 teaspoons of glycerine. The glycerine acts as an emulsifier which causes the detergent and water to stay mixed. Up to 4 more cups of water can be added if the climate is dry or if the bubbles seem heavy and sink to the ground. Since the bubble solution 46 improves with age, it is best to let it age overnight before use.

Referring now to FIGS. 3–4, after the apparatus 10 has been immersed in the bubble solution 46, the operator lifts the apparatus 10 out of the vat 44. If, upon lifting the apparatus 10 out of the vat 44, a film 48 is already attached to the wick means 12 as shown in FIG. 3, then the operator may orient the apparatus directly into the bubble-developing position of FIG. 4 by moving the control wand 18 out and up as will be explained more fully below. On the other hand, if upon lifting the apparatus 10 out of the vat 44, there is no film 48 formed, then the operator must first orient the apparatus into the bubble initiating position of FIG. 1.

In order to form the film 48, the apparatus 10 is disposed in the bubble initiating position. In this position, the wands are manipulated so that the first segment 32 and the second segment 34 depend from the support wand 16 and the third segment 36 depends from the control wand 18. FIG. 1 depicts apparatus 10 essentially in the bubble-initiating position but, for purposes of clarity of illustration, with a small space 42 between the halves of the loop or wick means 12. In the true bubble-initiating position, there is ideally no space 42 between the segments of the wick means 12. The contact means 40 is in substantial contact with the first segment 32, and the second segment 34 and the third segment 36, should be substantially, and preferably totally, flush all along the length of the first segment 32. Most importantly, the contact means 40 must fill the gap 38 and be in substantial contact with the first segment 32.

To dispose the apparatus in the bubble-initiating position, the support wand 16 is positioned to pull on the second segment 34 and the first segment upper portion 32*a*. This causes the second segment 34 to lie flush against the first segment upper portion 32*a*. Similarly, the weight means 14 is positioned opposite the wick receiving portion 22 of the support wand 16 to effectively serve as a third wand by downwardly pulling, through the force of gravity, the first segment lower portion 32*b* and the third segment 36. This causes the third segment 36 to lie flush against the first segment lower portion 32*b*. It will be appreciated by those skilled in the art that any type and any shape of weight means 14 can be used as long as it functions to pull on the wick means 12 to cause the third segment 36 to lie flush against the first segment lower portion 32*b*.

The control wand 18 is now positioned to place the contact means 40 in substantial contact with the first segment 32 which commences the production of a film. Because the second segment 32, and the third segment 36 are in substantially flush engagement with the length of the first segment 32, a film materializes all along the length of the wick means 12 from which film a bubble may now be formed. The contact means 40, by filling the gap 38, effectively creates an operatively continuous loop and, when disposed in substantial contact with the first segment 32, it functions as a catalyst in the formation of the film. If there were space between the second segment 34 and the third segment 36, i.e. if the contact means 40 did not fill the gap 38, then a film would not reliably materialize.

Once the film 48 materializes, the operator moves the control wand 18 out and up, stretching the film 48 from the position of FIG. 3 to the bubble-developing position of FIG. 4. The contact means 40 and portions of the second and third segments 34 and 36 are now substantially spaced apart from the first segment 32 to allow for maximum expansion of the film 48. The second segment 34 now depends from both the support wand 16 and the control wand 18, and the weight means 14 and the support wand 16 are now closer together than in the bubble initiating position. It is from this position that the film 48 is contorted to form a bubble.

Referring now to FIG. 5, a bubble 52 is formed from the bubble developing position by allowing a volume of air 50 to pass into the film 48. The volume of air 50 is made to pass into the film by either holding the apparatus 10 into a breeze, or by swinging the apparatus 10, thereby creating a flow of air relative thereto. The use of the two wands 16 and 18 afford a finer degree of control over the formation of bubbles than any of the single wand or rigid hoop prior art devices. When the bubble 52 matures to a size satisfactory to the operator, the control wand 18 is moved into a bubble releasing position, identical to the bubble initiating position of FIG. 1, wherein the bubble 52 will seal and float away.

In the bubble-releasing position, like the bubble-initiating position, the contact means 40 is moved into substantial contact with the first segment 32 so that the second segment 34 and the third segment 36 are substantially flush all along the length of the first segment 32. As a result, the edges of the bubble 52 attached to the segments are merged so that the bubble 52 floats free as shown in FIG. 6. In the devices of the prior art where the bubble forming loop is not operatively continuous and the segments are not in substantially complete flush engagement, the user cannot control the size of the bubble because the edges of the bubble attached to the loop can not be effectively merged to separate the bubble from the loop when the operator so elects.

Preferably the apparatus 10 is capable of successively forming bubbles from the bubble solution stored in the wick means 12. Thus, the bubble-releasing position of one bubble is the bubble-initiating position of a successive bubble. FIG. 6 shows the apparatus 10 between the bubble-releasing/bubble initiating position and the bubble developing position. Once the bubble 52 has been separated from the wick means 12 by disposing the apparatus in the bubble-releasing position, a second film 54 materializes between the segments. Thus the bubble releasing position of apparatus 10 for bubble 52 is the bubble initiating position for the bubble to be formed from film 54. In contrast, the apparatuses of the prior art, which do not allow for substantially complete flush engagement of the segments, cannot form successive bubbles from bubble solution stored in the wick means. Each time a bubble is to be formed, the prior art apparatus must be re immersed to materialize a film from which a bubble is to be formed.

The degree of control afforded by the dual wand design of the apparatus allows giant bubbles to be started, expanded, carefully "closed", and separated without bursting. Spherical soap bubbles up to eight feet in diameter can be made, and even larger bubbles might be produced by enlarging the apparatus. These huge spherical bubbles are quite stable, depending somewhat on air turbulence, and often last for several minutes before bursting. The unusual stability of these bubbles, which during formation are oblong or pear shaped, is achieved by the precise control given by use of the apparatus, which regulates the emerging shape, avoiding bubble necks and keeping a stable diameter/-length ratio.

The apparatus also allows a variety of large non spherical bubbles to be made, which, though less stable, are still spectacular. Tubular, dumbell-shaped, and branching bubbles up to forty feet long and fifteen feet wide (in the branches) can be produced. Huge double bubbles, triples, clusters, and chains can be created by careful manipulations of the device. Clouds of small bubbles can be created, and small bubbles made to whirl inside larger ones. All this can be accomplished by using the recommended mixture of ordinary dish detergent, water, and glycerine which, incidentally, produces brilliant iridescent colors. The apparatus can be operated by a child, but the largest, most interesting effects challenge the skill of an adult.

To summarize, the bubble toy of the present invention affords a fine degree of control over the formation and size of giant bubbles. It provides effective separation of the bubbles from the bubble-forming loop as well as successively yielding a plurality of bubbles from bubble-solution stored in the loop. The loop is non-rigid and collapsible which allows for the use of a small vat or container of bubble solution. The bubble toy is lightweight, easy to use and easy to maintain, as well as having a simple and economical construction, being inexpensive to manufacture and use, and enjoyable to use by both children and adults alike.

Now that the preferred embodiments have been shown and described in detail, various modifications and improvements thereon will become readily apparent to those skilled in the art. Accordingly, the appended claims are to be construed broadly and in a manner consistent with the spirit and scope of the present invention.

We claim:

1. An apparatus for forming and controlling bubbles formed from a bubble solution, comprising:

(A) an operatively continuous wick means for storing and releasing quantities of a bubble solution, said wick means including in series a first elongate segment, a second elongate segment and a third elongate segment, said first and third segments defining a point therebetween, and said first segment being substantially equal in length to said second and third segments combined;

(B) a control wand and a support wand for moving said wick means between a bubble-initiating position and a bubble-developing position, said control wand being fixedly secured during use to said wick means between said second and third segments, and said support wand being fixedly secured during use to said wick means between said first and second segments; and (C) means fixedly secured to said point between said first and third segments of said wick means for causing adjacent ends of said first and third segments at said point to be substantially flush against each other when in the bubble-initiating position to prevent a gap therebetween.

2. The apparatus of claim 1 wherein said apparatus further comprises contact means to cause said second and third segments to be operatively linear such that in said bubble-initiating position said control wand causes said contact means and said second and third segments to be in substantially flush contact with said first segment to form a film between said contact means and said segments, and in said bubble-developing position said contact means and portions of said second and third segments are substantially spaced apart from said first segment to form the bubble from the film.

3. The apparatus of claim 2 wherein said contact means is comprised of wick filler.

4. The apparatus of claim 3 wherein said contact means projects slightly outwardly from said wick means.

5. The apparatus of claim 4 wherein said contact means projects towards said first segment in said bubble-initiating position.

6. The apparatus of claim 2 wherein said second and third segments and said contact means are substantially flush all along the length of said first segment in said bubble-initiating position.

7. The apparatus of claim 2 wherein adjacent portions of said second and third segments form with said contact means an operatively flush surface capable of flush engagement with said first and segment in said bubble-initiating position.

8. The apparatus of claim 2 wherein major lengths of said second and third segments and said contact means are spaced from said first segment in said bubble-developing position.

9. The apparatus of claim 2 wherein said control wand is capable of moving said wick means from said bubble-developing position to a bubble-releasing position wherein said second and third segments are in substantially flush contact with said first segment and said contact means is in substantially flush contact with said first segment so that the formed bubble is sealed and released.

10. The apparatus of claim 9 wherein said apparatus is capable of successively forming bubbles from the bubble solution stored in said wick means.

11. The apparatus of claim 10 wherein said bubble-releasing position for one bubble is said bubble-initiating position for a successive bubble.

12. The apparatus of claim 9 wherein in said bubble-initiating and bubble releasing positions, said second and third segments are substantially flush all along the length of said first segment.

13. The apparatus of claim 9 wherein in said bubble-initiating and bubble-releasing positions, said second and third segments are substantially flush all along the length of said first segment, and said contact means is in substantially flush contact with said first segment.

14. The apparatus of claim 1 wherein said second and third segments are operatively linear to cause said second and third segments to be in substantially flush contact with said first segment in said bubble-initiating position, so that a film may be formed between said segments, and in said bubble-developing position portions of said second and third segments are substantially spaced apart from said first segment so that the bubble may be formed from the film.

15. The apparatus of claim 1 wherein said fixedly secured means is a weight means.

16. The apparatus of claim 15 wherein said weight means is disposed opposite said wick-receiving portion of said support wand in said bubble-initiating position.

17. The apparatus of claim 15 wherein said weight means and said support wand are closer together in said bubble-developing position than in said bubble-initiating position.

18. The apparatus of claim I wherein said control wand is capable of moving said wick means from said bubble-developing position to a bubble-releasing position wherein said second and third segments are in substantially flush contact with said first segment so that the formed bubble is sealed and released.

19. The apparatus of claim 1 wherein in said bubble-initiating position, said fixedly secured means causes said third segment and a lower portion of said first segment to be substantially flush against each other, and said support wand causes said second segment and an upper portion of said first segment to be substantially flush against each other, whereby a film is formed between said segments.

20. The apparatus of claim 19 wherein said fixedly secured means is a weight means depending from said point between said first and third segments of said wick means.

21. The apparatus of claim 1 wherein each said wand includes a wick receiving portion for receiving and securing said wick means to said wand, said wick-receiving portion of said support wand receiving and securing adjacent portions of said first and second segments and securing portions of said second and third segments.

22. The apparatus of claim 1 wherein said wick means comprises double-rolled wick material.

23. The apparatus of claim 22 wherein said wick material is cotton knitted in a lock weave.

24. The apparatus of claim 1 wherein said fixedly secured means is a sleeve fitted over said adjacent ends of said first and third segments.

25. The apparatus of claim 1 wherein said wands are of different visual appearance.

26. The apparatus of claim 15 wherein said wands are of a different color.

27. The apparatus of claim 1 wherein said wick means comprises a loop of wicking material.

28. The apparatus of claim 1 wherein said second and third segments are of essentially equal length.

29. The apparatus of claim 1 wherein said apparatus is capable of successively forming bubbles from the bubble solution stored in said wick means.

30. An apparatus for forming and controlling bubbles formed from a bubble-solution, comprising:

(A) an operatively continuous wick means for storing and releasing quantities of a bubble solution to successively form bubbles from the bubble solution stored in said wick means, said wick means including a first elongate segment, a second elongate segment and a third elongate segment, said first segment being substantially equal in length to said second and third segments combined, and said first and third segments defining a point therebetween;

(B) a control wand and a support wand having different visual appearances, each having a handle portion adjacent one end thereof for manually grasping said wand, a wick-receiving portion adjacent the opposite end thereof fixedly securing said wick means to said wand during use, and an elongated shank portion therebetween, said wick-receiving portion of said support wand receiving and securing adjacent portions of said first and second segments, and said wick-releasing portions of said control wand receiving and securing portions of said second and third segments;

(C) means including a weight means fixedly secured to said point between said first and third segments of said wick means for causing adjacent ends of said first and third segments at said point to be substantially flush against each other when in the bubble-initiating position to prevent a gap therebetween; and (D) contact means to cause said second and third segments to be operatively linear;

said weight means and said support wand defining therebetween said first segment of said wick means, said support wand and said control wand defining therebetween said second segment of said wick means, and said weight means and said control wand defining therebetween said third segment of said wick means; and said wands being capable of moving said wick means between a bubble-intiiating position and a bubble-developing position, in said bubble-initiating position said control wand being positioned to cause said contact means to be in substantial contact with said first segment, said weight means being positioned opposite said wick-receiving portion of said support wand and causing said third segment and a lower portion of said first segment to be substantially flush against each other, and said support wand being positioned to cause said second segment and an upper portion of said first segment to be substantially flush against each other, so that a film is formed, and in said bubble-developing position said contact means and portions of said second and third segments being substantially spaced apart from said first segment so that the bubble may be formed from the film.

31. The apparatus of claim 30 wherein said control wand is capable of moving said wick means from said bubble-developing position to a bubble-releasing position wherein said second and third segments are substantially flush against said first segment and said contact means is in substantial contact with said first segment so that the formed bubble is sealed and released.

32. The apparatus of claim 31 wherein said bubble releasing position for one bubble is said bubble initiating position for a successive bubble.

* * * * *